US007225960B2

(12) United States Patent
Chen

(10) Patent No.: US 7,225,960 B2
(45) Date of Patent: Jun. 5, 2007

(54) LOCKING DEVICE FOR MAGAZINE OF STAPLERS

(76) Inventor: Hsiu-Chiang Chen, 3f-5, No.22, Lane 146, De-Fu Road, South Area, Taichung City (TW)

( * ) Notice: Subject to any disclaimer, the term of this patent is extended or adjusted under 35 U.S.C. 154(b) by 0 days.

(21) Appl. No.: 11/147,133

(22) Filed: Jun. 7, 2005

(65) Prior Publication Data

US 2006/0273131 A1 Dec. 7, 2006

(51) Int. Cl.
*B25C 5/02* (2006.01)

(52) U.S. Cl. ..... 227/120; 227/127; 227/156

(58) Field of Classification Search ..... 227/120, 227/125–127, 134, 156
See application file for complete search history.

(56) References Cited

U.S. PATENT DOCUMENTS 2,746,043 A * 5/1956 Zaller ..... 227/132
3,905,535 A * 9/1975 Novak et al. ..... 227/120
4,304,349 A * 12/1981 Novak et al. ..... 227/130
5,368,213 A * 11/1994 Massari, Jr. ..... 227/120
5,588,577 A * 12/1996 Chen ..... 227/120
5,632,431 A * 5/1997 Lin ..... 227/109
5,695,108 A * 12/1997 Lee ..... 227/109
5,782,395 A * 7/1998 Sauer ..... 227/130
5,899,374 A * 5/1999 Chen ..... 227/120
6,189,759 B1 * 2/2001 Canlas et al. ..... 227/120
6,913,180 B2 * 7/2005 Schuster ..... 227/109
7,000,294 B2 * 2/2006 Kakuda et al. ..... 227/120
7,070,082 B2 * 7/2006 Ronconi ..... 227/127

* cited by examiner

*Primary Examiner*—John Sipos
*Assistant Examiner*—Michelle Lopez
(74) *Attorney, Agent, or Firm*—Charles E. Baxley

(57) ABSTRACT

A locking device for preventing the movable plate from disengaging from the fixed portion of the magazine includes a substantially V-shaped lever which includes an operation end, a contact end and a pivotable end which is located between the operation end and the contact end. The contact end extends through a port of the fixed portion and located beside a stop extending from the movable plate so as to stop the movable plate from moving away from the nose. A biasing member is bent to be substantially V-shaped and contacting an inside of a section between the operation end and the pivotable end and an outside of the fixed portion. The contact end can be moved away from the stop by pivoting the operation end about the pivotable end so that the movable plate can be slidably disengaged from the fixed portion to reload staples.

2 Claims, 7 Drawing Sheets

LOCKING DEVICE FOR MAGAZINE OF STAPLERS

FIELD OF THE INVENTION

The present invention relates to a locking device that prevents the movable plate of the magazine from disengaging from fixed portion of the magazine when the staples are jammed.

BACKGROUND OF THE INVENTION

A conventional pneumatic stapler is disclosed in FIG. 1, and generally includes a barrel with a nose portion 3 through which staples are ejected therefrom, a handle connected to the barrel, and a magazine 1 for storing the staples is connected to the nose portion 3. The handle includes a connection member 4 which is fixed to a fixed portion 10 of the magazine 1 and a movable plate 11 is slidably connected to the fixed portion 10 so that the staples are stored in a space between the movable plate 11 and the fixed portion 10. A locking device 2 is pivotably connected to a protrusion 13 on the fixed portion 10 by a pin 14 and includes a lever 20 and a hook portion 21. The pin 14 is located between the lever 20 and the hook portion 21 so that when pivoting the lever 20, the hook portion 21 is moved between a locked position as shown in FIG. 1 to hook on a bottom of the movable plate 11, and a unlock position as shown in FIG. 3 to allow the movable plate 11 slidably removed from the fixed portion 10. As shown in FIG. 2, when one of more than one staples 50 are deformed by the impact from the push plate 51, the deformed staples 50 applies a force to the rest of the staples 50 in the magazine 1 and the force might unhooks the hook portion 21 as shown in FIG. 2. Therefore, the movable plate 11 is loosened and the staples 50 cannot be properly fed to the nose portion 3. Besides, when loading the staples 50, the user has to hold the handle by one hand and the other hand operates the lock device 3. This requires both hands to complete the loading action and is not convenient for the users during working.

The present invention intends to provide a locking device that is operated by only the hand holding the handle and effectively prevents the movable plate from loosing when the staples are deformed.

SUMMARY OF THE INVENTION

The present invention relates to a stapler which comprises a barrel with a nose connected to a front end thereof and a handle connected to the barrel. A trigger is connected to the handle. A magazine is connected between the nose and an connection extension extending from the handle. The magazine 2 includes a fixed portion and a movable plate which is slidbaly engaged with grooves defined in the fixed portion. A port is defined in a side of the second end of the fixed portion of the magazine and the movable plate has a stop which is located in the port. A locking device includes a lever and a biasing member, wherein the lever is a substantially V-shaped member and has an operation end, a contact end and a pivotable end which is located between the operation end and the contact end. The contact end extends through the port and is located beside the stop to stop the movable plate from moving away from the nose. The biasing member is bent to be substantially V-shaped and contacts an inside of a section between the operation end and the pivotable end and an outside of the fixed portion. The contact end is moved away from the stop when pivoting the operation end so that the movable plate can be slidably disengaged from the fixed portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
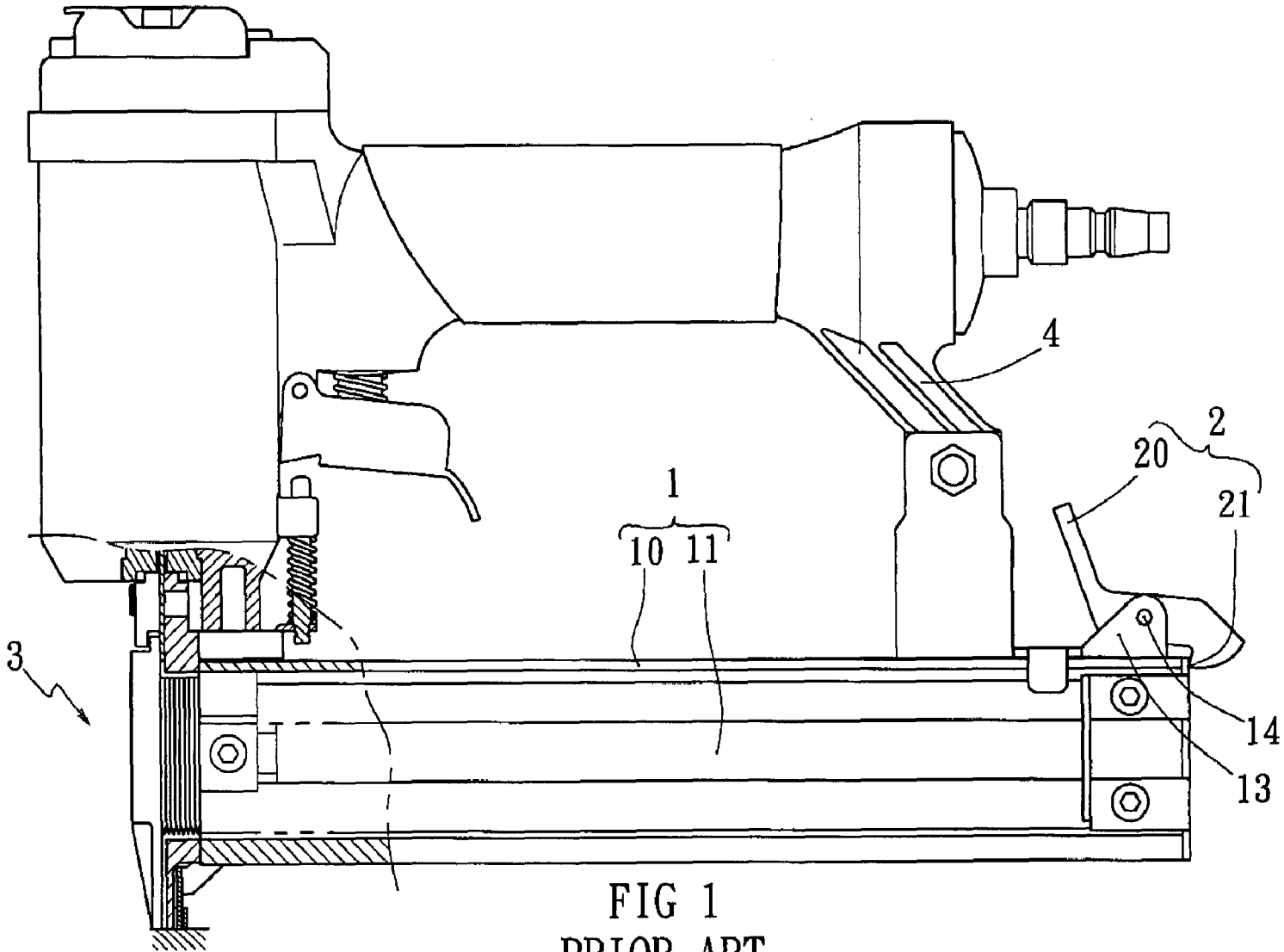
FIG 1 PRIOR ART
FIG. 1 shows a conventional locking device for locking the magazine of the stapler.
Figure 2:
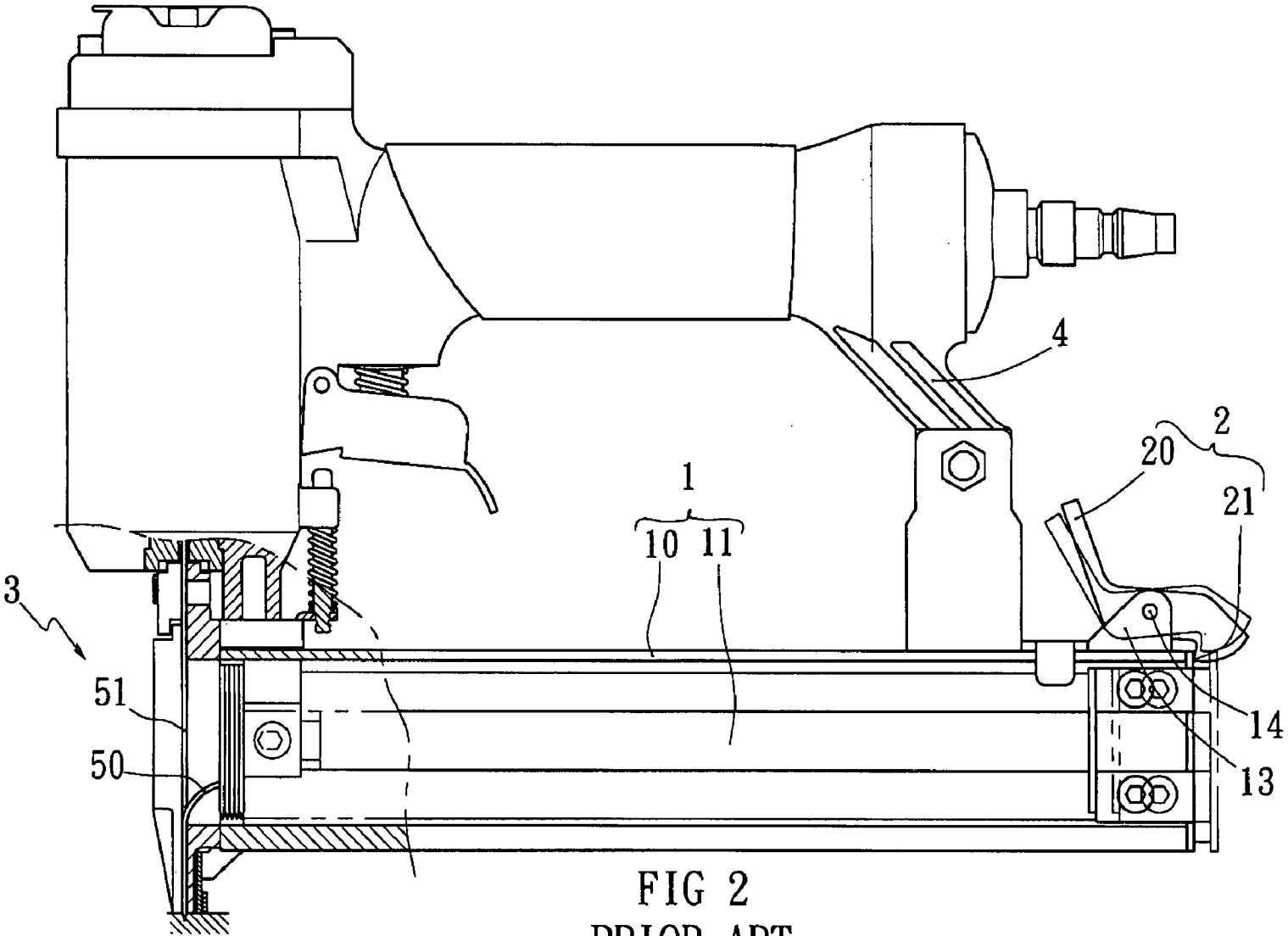
FIG 2 PRIOR ART
FIG. 2 shows that the movable plate of the magazine of the stapler hits and unlocks the conventional locking device.
Figure 3:
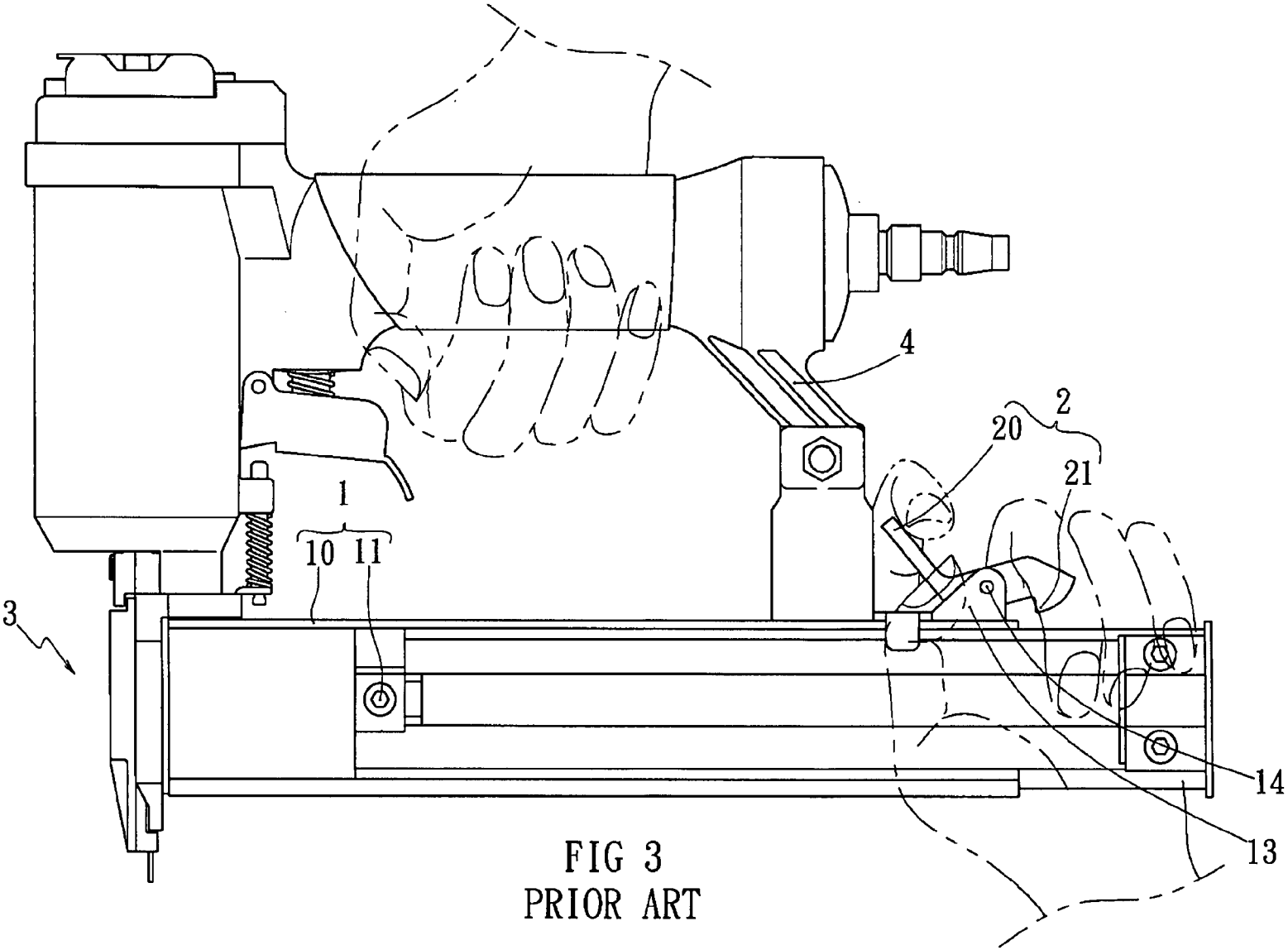
FIG 3 PRIOR ART
FIG. 3 shows that two hands are required to reload staples into the magazine with the conventional locking device.
Figure 4:
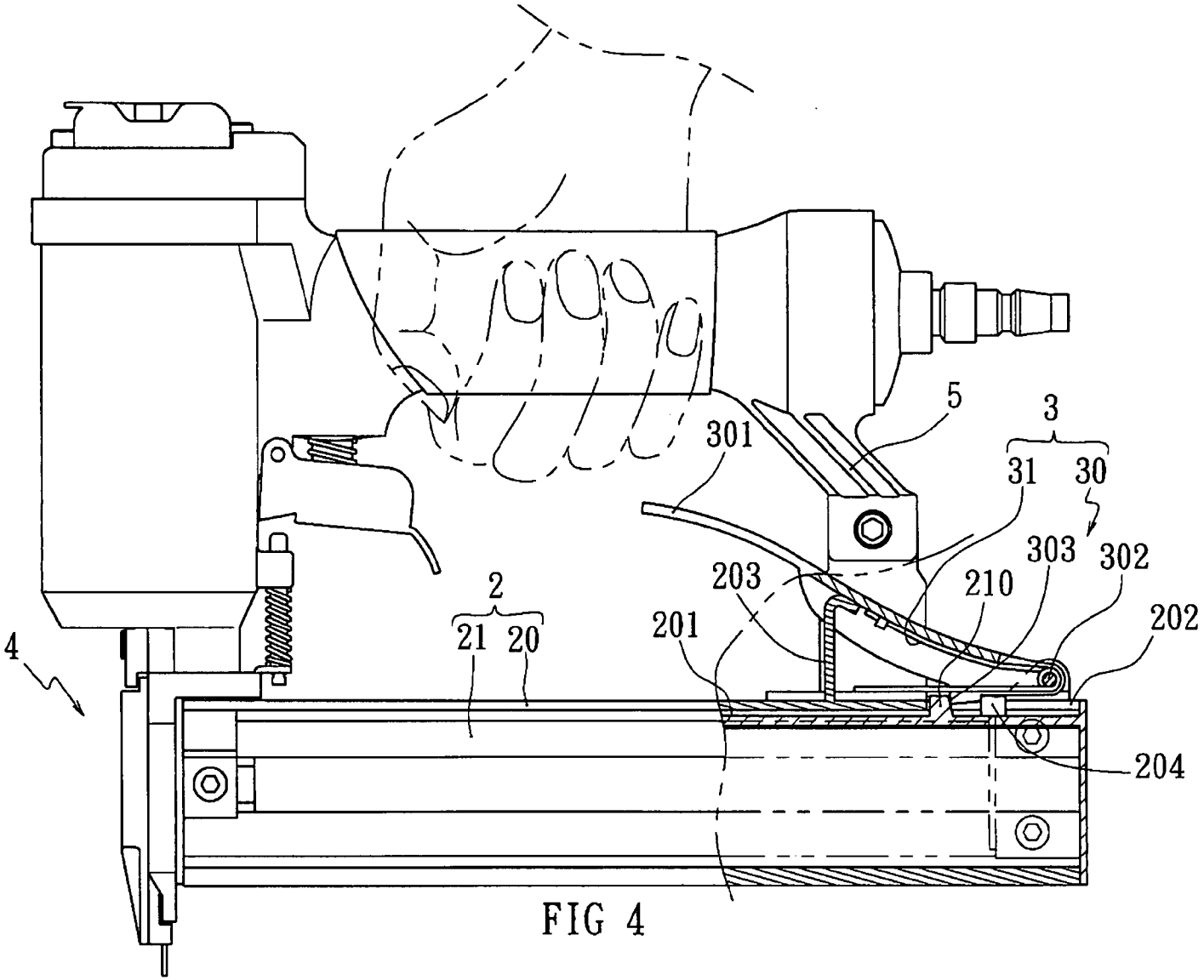
FIG. 4 shows the locking device of the present invention on a stapler.

Referring to FIG. 4, the stapler of the present invention comprises a barrel with a nose 4 connected to a front end thereof and a handle connected to the barrel. A trigger is connected to the handle which includes connection extension 5.

A magazine 2 has a first end connected to the nose 4 and a second end of the magazine 2 is connected to the connection extension 5 extending from the handle. The magazine 2 includes a fixed portion 20 and a movable plate 21 which is slidbaly engaged with grooves 201 defined in the fixed portion 20. A port 202 is defined in a side of the second end of the fixed portion 20 of the magazine 2. The movable plate 21 has a stop 210 which is located in the port 202.

A locking device 3 includes a substantially V-shaped lever 30 and a biasing member 31. The lever 30 includes an operation end 301, a contact end 303 and a pivotable end 302 which is located between the operation end 301 and the contact end 303. The contact end 303 extends through the port 202 and located beside the stop 210 so as to stop the movable plate 21 from moving away from the nose 4. The biasing member 31 is bent to be substantially V-shaped and contacts an inside of a section between the operation end 301 and the pivotable end 302, and an outside of the fixed portion 20. An extending bar 203 extends laterally from the fixed portion 20 and contacts the inside of the section between the operation end 301 and the pivotable end 302 so as to keep the lever 30 as a V-shaped member. A fulcrum member 204 extends from the fixed portion 20 and contacts against a middle portion of a section between the contact end 303 and the pivotable end 302. Therefore, when the staples are jammed and deformed, the movement of the movable plate 21 is stopped by the contact end 303. The fulcrum member 204 provides a force to push the middle portion of the section between the contact end 303 and the pivotable end 302 to further move the contact end 303 toward the movable plate 21 to ensure that the movement of the movement of the movable plate 21 is stopped.

Figure 5:
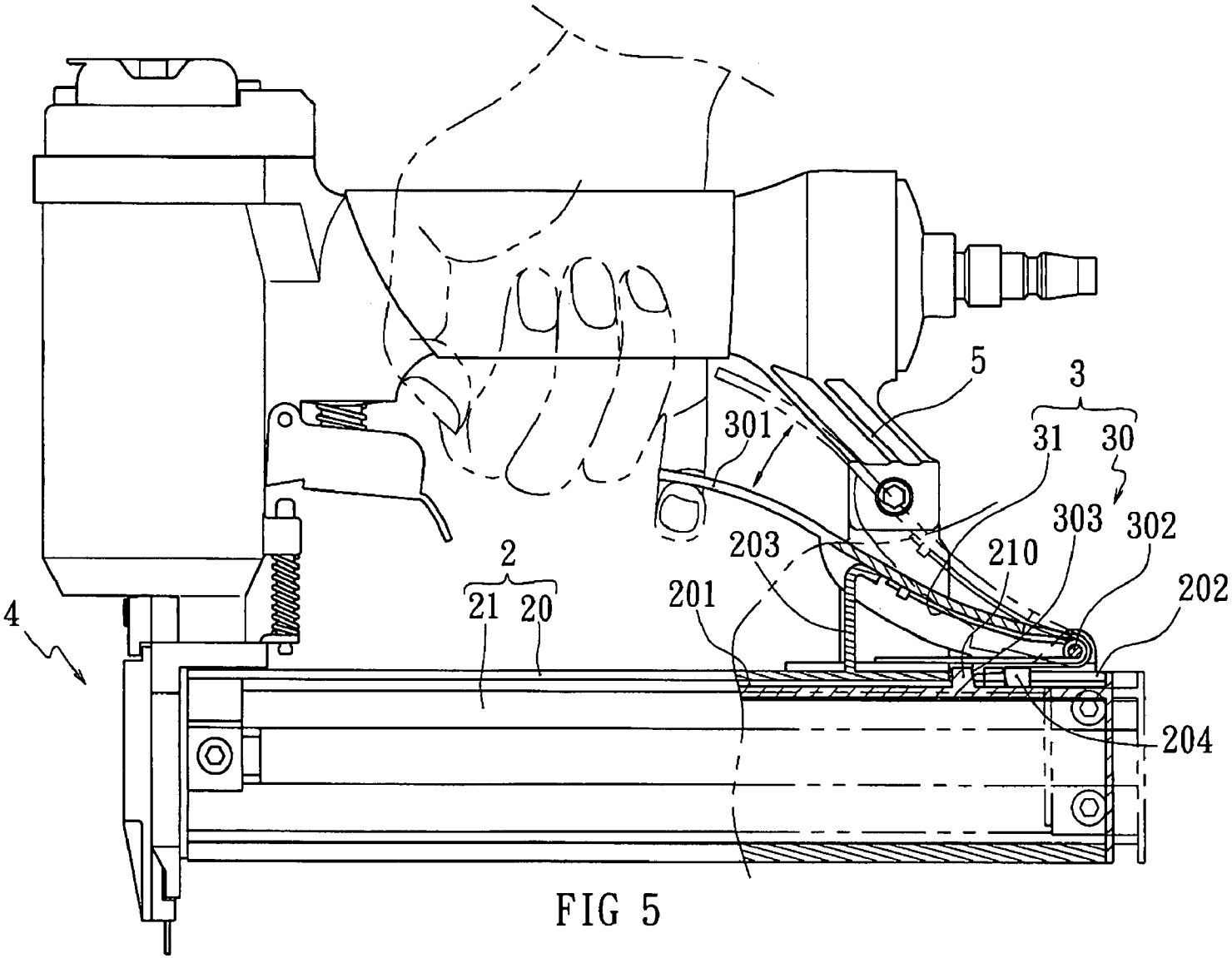
FIG. 5 shows the user pivots the operation end of the lever to unlock the locking device of the present invention.

As shown in FIG. 5, when reloading staples, the user simply pulls the operation end 301 by his or her little finger, the contact end 303 is pivtoted about the pivotable end 302 and moved away from the stop 210, so that the movable plate 21 is slidably disengaged from the fixed portion 20.

Figure 6:
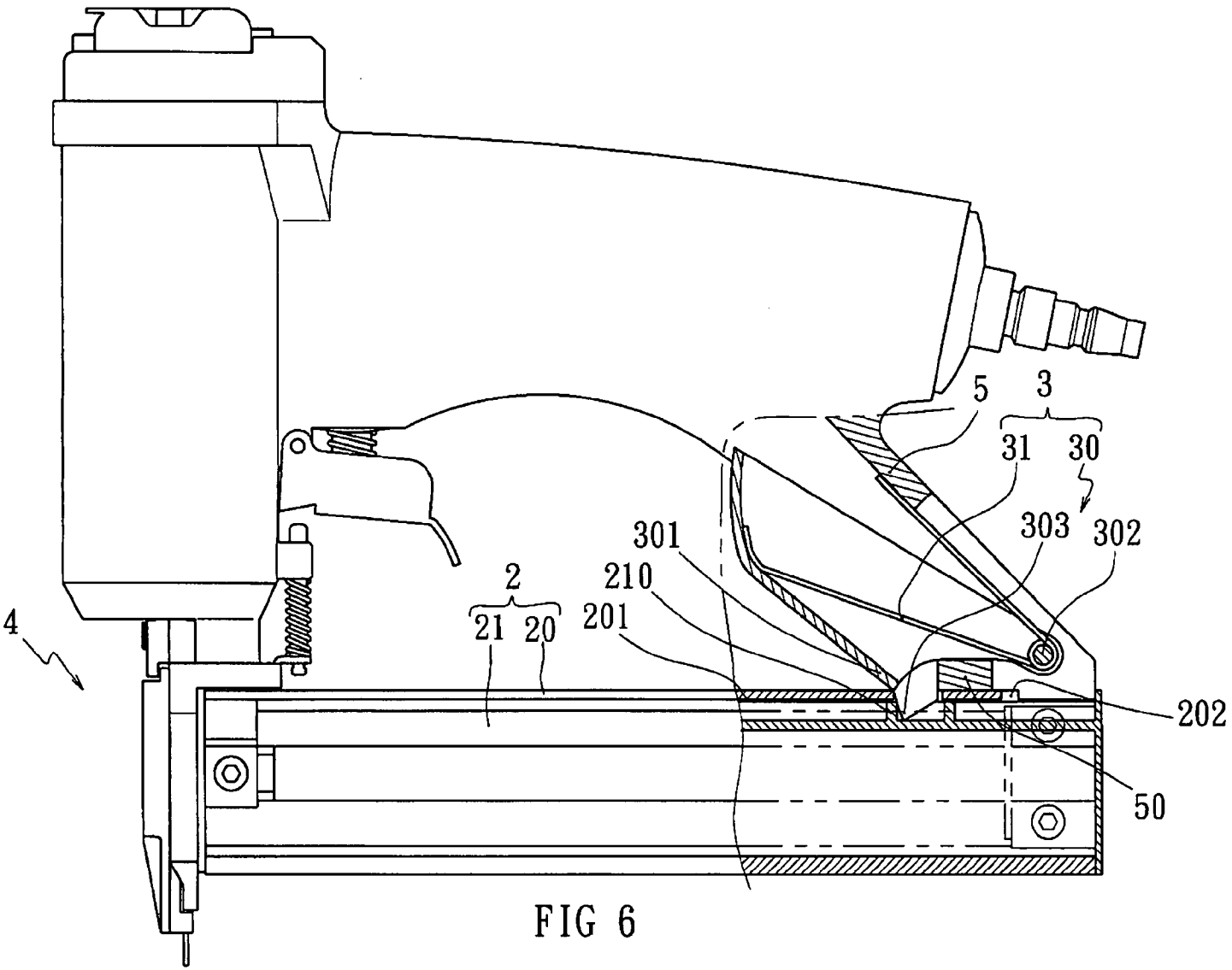
FIG. 6 shows another embodiment of the locking device of the present invention.
Figure 7:
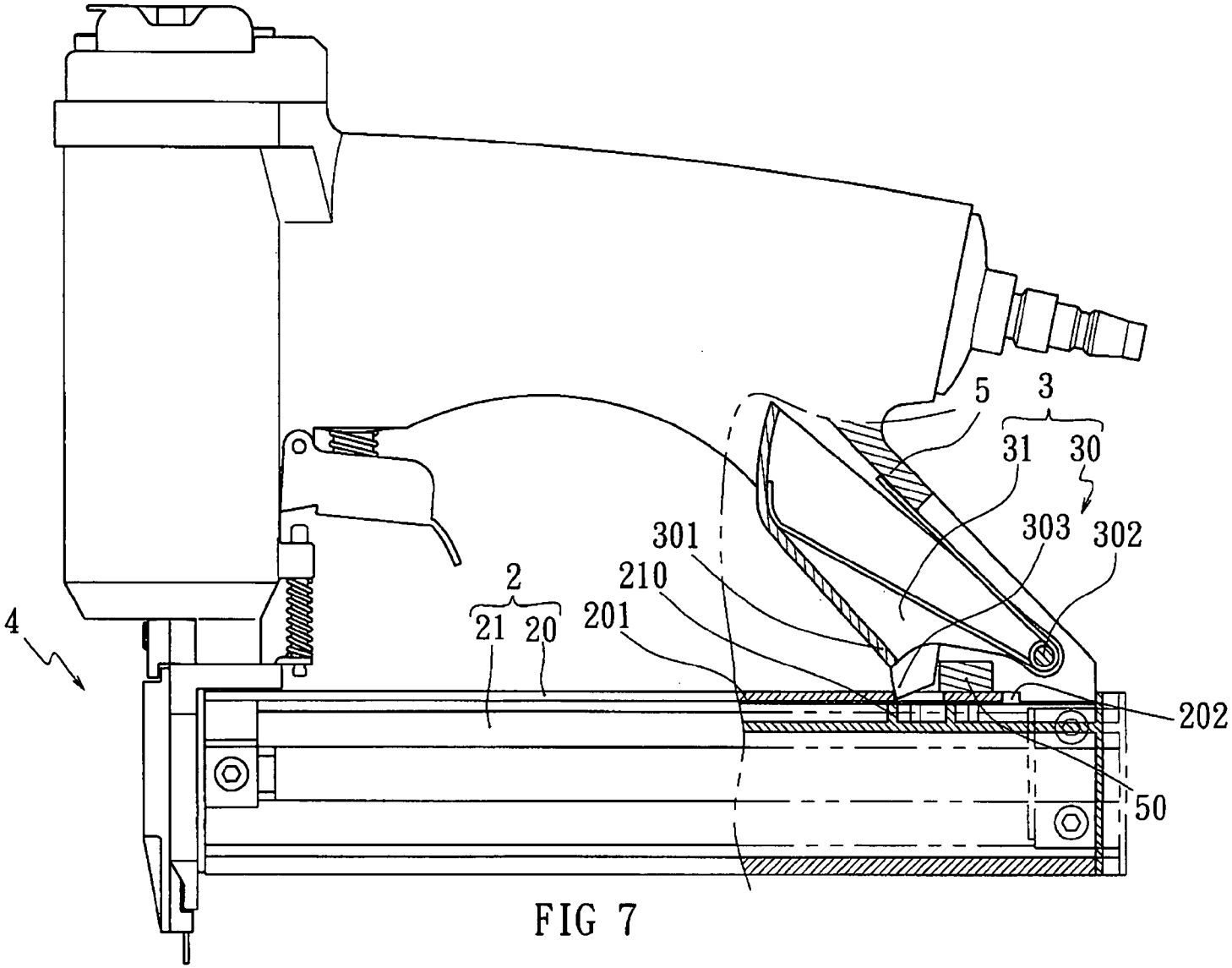
FIG. 7 shows that the locking device is unlocked.

FIGS. 6 and 7 show another embodiment of the locking device of the present invention, wherein the lever 30 extends from the connection extension 5 and the operation end 301 of the lever 30 is toward the second end of the magazine 2, the biasing member 31 is located between the connection extension 5 and the operation end 301. The contact end 303 extends through the port 202 and contacts the stop 210. A block 50 extends from the fixed portion 20 of the magazine 2 plays the same role as the fulcrum 204 in FIG. 5.

While we have shown and described the embodiment in accordance with the present invention, it should be clear to those skilled in the art that further embodiments may be made without departing from the scope of the present invention.

What is claimed is:

1. A stapler comprising:

a barrel with a nose connected to a front end thereof and a handle connected to the barrel, a trigger connected to the handle;

a magazine having a first end connected to the nose and a second end of the magazine connected to an connection extension extending from the handle, the magazine including a fixed portion and a movable plate which is slidbaly engaged with grooves defined in the fixed portion, a port defined in a side of a second end of the fixed portion of the magazine, the movable plate having a stop which is located in the port, and a locking device including a lever and a biasing member, the lever being a substantially V-shaped member and having an operation end, a contact end and a pivotable end which is located between the operation end and the contact end, the contact end extending through the port and located beside the stop so as to stop the movable plate from moving away from the nose, a fulcrum member extending from the fixed portion and contacting against a middle portion of a section between the contact end and the pivotable end of the lever, the biasing member being a substantially V-shaped member and contacting an inside of a section between.

2. The stapler as claimed in claim 1, wherein an extending bar extends from the fixed portion and contacts the inside of the section between the operation end and the pivotable end.

* * * * *